US009306298B2

(12) United States Patent
France et al.

(10) Patent No.: US 9,306,298 B2
(45) Date of Patent: Apr. 5, 2016

(54) TERMINAL BLOCK

(71) Applicant: ABB FRANCE, Courtaboeuf (FR)

(72) Inventors: Philippe France, Chazelles sur Lyon (FR); Romain Villard, Tassin la Demi Lune (FR)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 14/281,637

(22) Filed: May 19, 2014

(65) Prior Publication Data

US 2014/0342618 A1 Nov. 20, 2014

(30) Foreign Application Priority Data

May 17, 2013 (FR) ..... 13 54452

(51) Int. Cl.
*H01R 9/22* (2006.01)
*H01R 9/26* (2006.01)

(52) U.S. Cl.
CPC ..... *H01R 9/2608* (2013.01)

(58) Field of Classification Search
CPC ..... H01R 9/26; H02B 1/052
USPC ..... 439/709, 716, 532, 94
See application file for complete search history.

(56) References Cited

U.S. PATENT DOCUMENTS 7,192,316 B1 * 3/2007 Pollmann ..... H01R 9/2675 439/716
8,939,800 B2 * 1/2015 Hoppmann ..... H01R 9/2675 439/513
2003/0045178 A1 * 3/2003 Huiskamp ..... H01R 4/24 439/709
2005/0250389 A1 11/2005 Johansen et al.
2007/0049129 A1 * 3/2007 Pollmann ..... H01R 9/2675 439/716

(Continued)

FOREIGN PATENT DOCUMENTS

DE 102007041979 B3 3/2009
EP 1182735 A2 2/2002
FR 2951349 A1 4/2011

OTHER PUBLICATIONS

Phoenix Contact: "Clipline complete PT—push-in connection technology for all applications", Dec. 31, 2012, pp. 15, XP055097598, URL:http://www.phoenixcontact.nl/local_content_pdf/pdf_nld/52006713_01_EN(1).pdf.

*Primary Examiner* — Abdullah Riyami
*Assistant Examiner* — Nader J Alhawamdeh
(74) *Attorney, Agent, or Firm* — Cantor Colburn LLP

(57) ABSTRACT

A terminal block including at least one housing for a connection terminal, the housing extending at least partly within a volume delimited by: a first plane transverse to two side planes delimiting the insulating body, substantially parallel to a general direction joining a first end and a second end of a fastening member, and passing through a connecting area of the fastening member, and a second plane transverse to the two side planes delimiting the insulating body, substantially parallel to the first plane and passing through a connecting area of the rear face, at least a third plane transverse to the two side planes delimiting the insulating body, substantially transverse to the first plane and to the second plane, and passing through the furthest elastic branch of the fastening means intended to interact with an edge of the support rail, and at least a fourth plane transverse to the two side planes delimiting the insulating body, substantially transverse to the first plane and to the second plane, and passing through a retaining member intended to lock a tool.

10 Claims, 2 Drawing Sheets

(56) References Cited

U.S. PATENT DOCUMENTS

2008/0233782 A1* 9/2008 Hoppmann ..... H01R 4/4827 439/259
2010/0203773 A1* 8/2010 Henke ..... H01R 9/2633 439/709
2014/0113502 A1* 4/2014 Barber ..... H01R 4/4836 439/709
2014/0127932 A1* 5/2014 Hoppmann ..... H01R 4/4827 439/370

* cited by examiner

Fig. 2
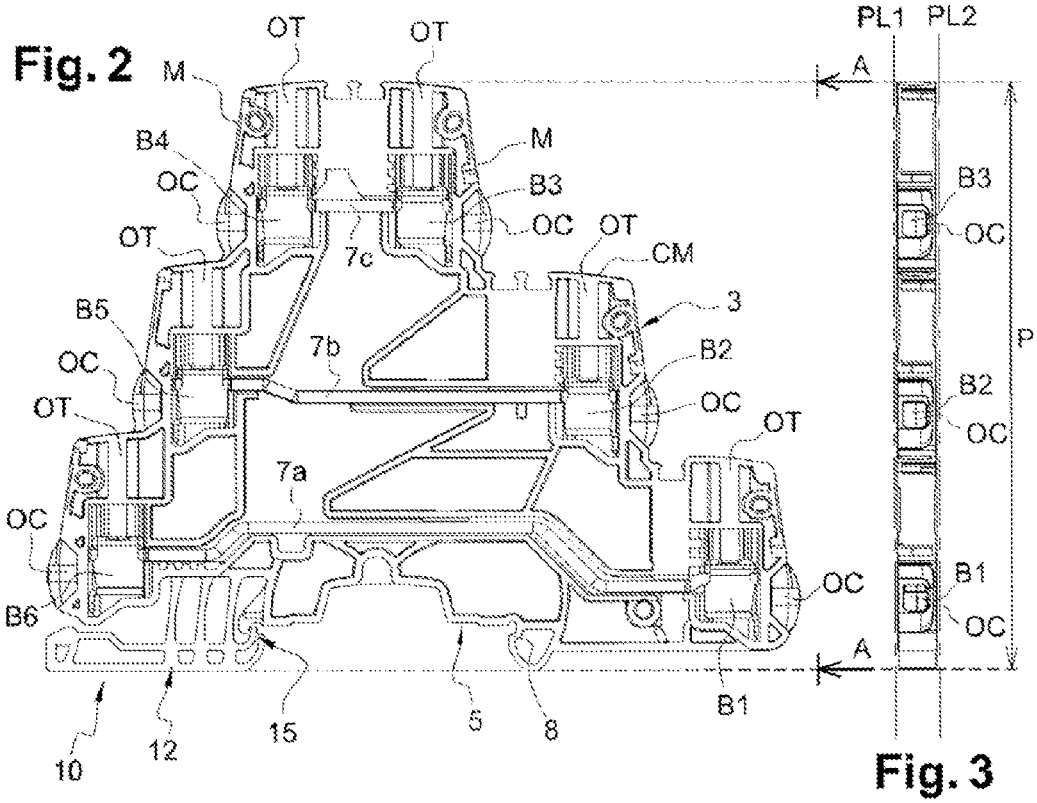
Fig. 3
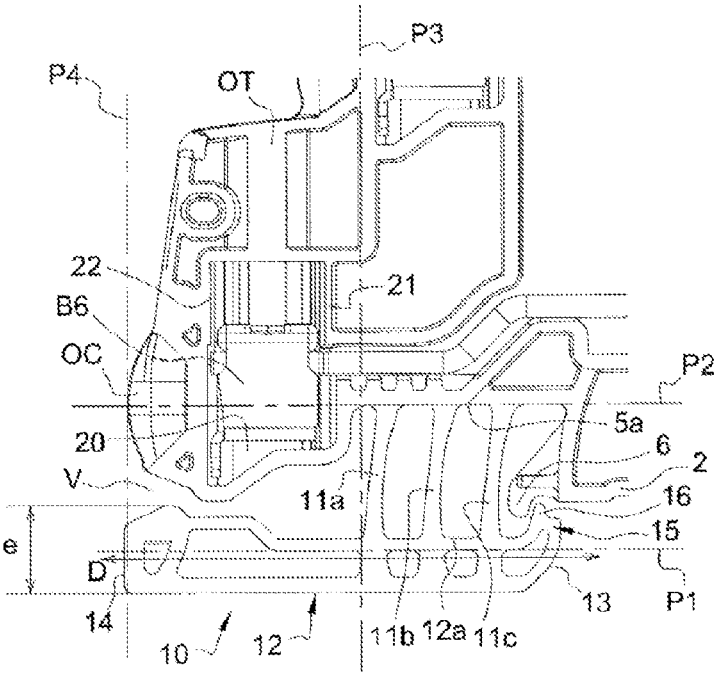
Fig. 4

TERMINAL BLOCK

CROSS REFERENCE TO RELATED APPLICATIONS

This application is related to and claims the benefit of French Patent Application Number 13/54452 filed on 17 May 2013, the contents of which are herein incorporated by reference in their entirety.

TECHNICAL FIELD

The present invention relates to the field of electrical apparatus of the terminal block type intended for connection of a low voltage electrical apparatus.

BACKGROUND

These terminal blocks are primarily intended to equip electrical cabinets or electrical boxes of industrial machines.

In many of these industrial machines, it is advisable to reduce the overall dimension of the electrical cabinet or of the electrical box.

The reduction of this overall dimension is associated in part to the reduction of the overall dimension of terminal blocks, in particular to the reduction of their overall depth.

It is known to create a terminal block including an insulating body delimited by two substantially parallel side planes, and a movable fastening foot linked to a connecting area of the rear face of the insulating body and intended to maintain the terminal block on a support rail.

Furthermore, such a terminal block comprises lead wire connection terminals disposed on its upper face and its lower face.

These lead wire connection terminals are distributed on these two faces on the depth of the terminal block and have a minimum spacing so as to maintain good utilization functionality.

However, the overall dimension of the fastening foot prevents the lead wire connection terminals on one of these two faces from being disposed further backwards of the terminal block, leading to terminal blocks with a relatively significant depth resulting in a significant overall dimension.

BRIEF SUMMARY

The present invention aims to overcome all or part of the aforementioned drawbacks.

To this end, the invention is a terminal block of the above-mentioned type characterized in that the fastening foot comprises at least two elastic branches linking the connecting area of the rear face of the insulating body and a connecting area of a fastening member, the fastening member having an elongated shape extending in a general direction between a first end comprising fastening means intended to interact with an edge of the support rail and a second end comprising a retaining member intended to lock a tool so as to move the fastening foot against the force exerted by the at least two elastic branches, and in that the terminal block comprises at least one housing for a connection terminal, said housing extending at least partly within a volume delimited by:

a first plane transverse to the two side planes delimiting the insulating body, substantially parallel to the general direction joining the first end and the second end of the fastening member, and passing through the connecting area of the fastening member, and a second plane transverse to the two side planes delimiting the insulating body, substantially parallel to the first plane and passing through the connecting area of the rear face, at least a third plane transverse to the two side planes delimiting the insulating body, substantially transverse to the first plane and to the second plane, and passing through the furthest elastic branch of the fastening means intended to interact with an edge of the support rail, and at least a fourth plane transverse to the two side planes delimiting the insulating body, substantially transverse to the first plane and to the second plane, and passing through the retaining member intended to lock a tool.

This arrangement allows to reduce the overall depth of the terminal block and thus its overall dimension in an electrical cabinet or an electrical box while maintaining a good utilization functionality of the terminal block.

This arrangement allows to gather all elastic branches to a same location on a same side with respect to the housing of the connection terminal in order to further reduce the overall dimension of the fastening foot.

According to one aspect of the invention, the length of the at least two elastic branches defined between the connecting area of the rear face of the insulating body and the fastening member is greater than the maximum thickness of the fastening member defined in a plane transverse to the first plane.

This arrangement allows to keep a good efficiency of the elastic branches while reducing the overall dimension of the fastening member.

According to one aspect of the invention, the retaining member comprises the wall of a housing arranged on the fastening member.

This arrangement allows to facilitate holding the tool on the retaining member.

Advantageously, the housing has a reinforcing rib.

This arrangement increases the robustness of the fastening foot and thus the terminal block.

According to one aspect of the invention, the insulating body comprises a lug intended to limit relative motion between an edge of the support rail and the fastening means of the fastening member.

This arrangement allows to protect the fastening means of the fastening member from improper installation or excessive action of the support rail.

According to one aspect of the invention, the fastening means of the fastening member comprise a lug intended to arrange a bearing for an edge of the support rail.

This arrangement allows to clamp the rail support between these edges and to limit the mechanical clearance between the terminal block and the support rail.

According to one aspect of the invention, the fastening foot is movable between a first rest position and at least a second position in which the lug of the insulating body is facing the lug of the fastening means of the fastening member.

According to one aspect of the invention, the fastening member has an I-shaped standard profile.

This arrangement allows to reduce the thickness of the fastening member while maintaining good stiffness.

According to one aspect of the invention, the fastening foot comprises three elastic branches.

This arrangement allows to strengthen the force exerted by the elastic branches and imparts robustness to the fastening foot.

According to one aspect of the invention, the connection terminal is movable within the housing, two of the walls of the housing transverse to the two side planes delimiting the insulating body being arranged to guide the motion of the connection terminal.

This arrangement allows to reduce, to the maximum, the volume of the housing while maintaining a good mobility of the connection terminal within said terminal block.

According to one aspect of the invention, the overall depth of the terminal block is less than 80 mm, preferably equal to 78.4 mm.

BRIEF DESCRIPTION OF THE DRAWINGS

In any case, the invention will be better understood with the following description, with reference to the attached schematic drawing representing, by way of non-limiting example, a terminal block according to the invention.

FIG. 2 shows a side view of a terminal block according to the invention.

FIG. 3 shows a sectional view along the plane AA of a terminal block according to the invention.

FIG. 4 shows a detailed view of a fastening foot of a terminal block according to the invention.

DETAILED DESCRIPTION

Figure 1:
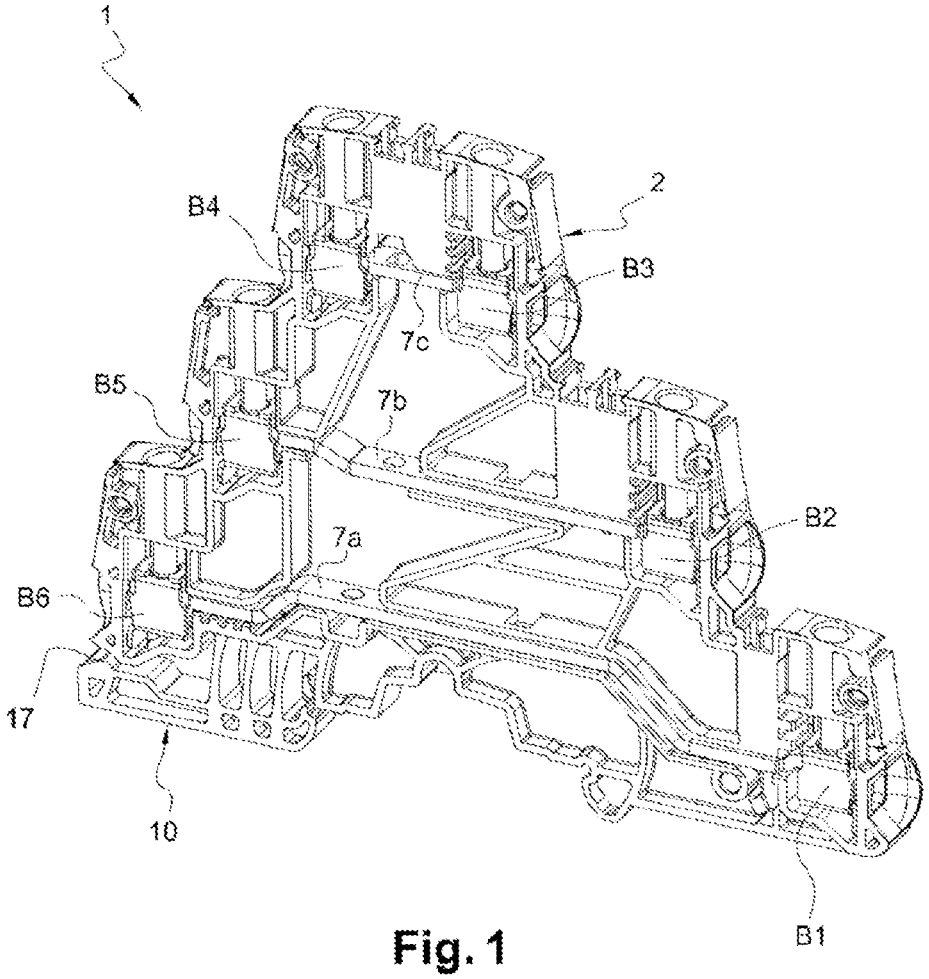
FIG. 1 shows a perspective view of a terminal block according to the invention.

As illustrated in FIGS. 1 to 3, a terminal block 1 according to the invention comprises an insulating body 2 delimited by two substantially parallel side planes PL1, PL2.

The insulating body 2 has in particular an upper face 3, a lower face 4 and a rear face 5, As illustrated in FIGS. 1 and 2, the upper face 3 and the lower face 4 have a staircase-shaped profile.

Furthermore, the upper face has three lead wire connection terminals B1, B2, B3 and the lower face has three other lead wire connection terminals B4, B5, B6.

Each of these lead wire connection terminals B1, B2, B3, B4, B5, B6 is movable in translation within a housing 20 with respect to a terminal strip 7*a*, 7*b*, 7*c* within the insulating body 2.

In each of the housings 20 come out a first aperture OT and a second aperture OC disposed transversely relative to each other.

Each first aperture AC is disposed on one step of the staircase profile of the upper 3 and lower 4 faces and is intended for the introduction of an electrical conductor in the connection terminal B1, B2, B3, B4, B5, B6.

Each second opening OT is disposed on an counter-step of the staircase profile of the upper 3 and lower 4 faces and is intended for the introduction of a tool, for example of the screwdriver type, allowing to set in motion the connection terminal B1, B2, B3, B4, B5, B6 and in particular its tightening or loosening.

The rotation of the screw of the terminal B1, B2, B3, B4, B5, B6 by the tool drives in translation the cage of the terminal B1, B2, B3, B4, B5, B6 that is tightening or loosening the electrical conductor against the terminal strip 7*a*, 7*b*, 7*c*.

During its translational motion, the cage of the terminal B1, B2, B3, B4, B5, B6 is guided by two side walls 21, 22 of housing 20.

In addition, as illustrated in FIGS. 1, 2 and 4, the terminal block 1 also comprises a movable fastening foot 10 linked to a connecting area 5*a* of the rear face 5 of the insulating body 2 and intended to hold the terminal block 1 on a support rail (not shown).

In the illustrated embodiment, the fastening foot 10 comprises three elastic branches 11*a*, 11*b*, 11*c* linking the connecting area 5*a* of the rear face 5 of the insulating body 2 and a connecting area 12*a* of a fastening member 12.

These three elastic branches 11*a*, 11*b*, 11*c* are disposed beside each other on a same side opposite to the lower face 4 with respect to the housing 20 of the connection terminal B6.

As illustrated in detail in FIG. 4, the fastening member 12 has an elongated shape with an I-shaped standard profile, and extends in a general direction D between a first end 13 and second end 14.

The first end 13 comprises fastening means 15 intended to interact with a first edge of the support rail.

Moreover, these fastening means 15 cooperate with second fastening means 8 disposed on the rear face 5 of the insulating body 2 and intended to interact with a second edge of the support rail so as to maintain the terminal block 1 on the support rail.

Typically, the second fastening means 8 are formed by a notch in which the second edge of the support rail is inserted.

The fastening means 15 comprise, in turn, a lug 16 forming a shoulder against which the first edge of the support rail can bear.

Moreover, the insulating body 2 also comprises a lug 6 intended to limit the relative motion between the first edge of the support rail and the fastening means 15 of the fastening member 12.

Thus, under the action of the tool, the fastening foot 10 is movable between a first rest position and at least a second position in which the lug 6 of the insulating body 2 is facing the lug 16 of the fastening means 15 of the fastening member 12.

The second end 14 comprises a retaining member 17 intended to lock the tool (not shown) so as to move the fastening foot 10 against the force exerted by the three elastic branches 11*a*, 11*b*, 11*c*.

The retaining member 17 comprises the wall of a housing (not shown) arranged on the second end 14 of the fastening member 12.

This housing is intended to receive the end of the tool so as to limit the sliding of this tool end on the fastening member 12.

In addition, this housing comprises a reinforcing rib (not shown) so as to limit the deformation of the housing under the action of the tool.

Finally, as illustrated in FIG. 4, the housing 20 of the connection terminal B6 extends partly within a volume V delimited by:

- A first plane P1 transverse to the two side planes PL1, PL2 delimiting the insulating body 2, substantially parallel to the general direction D joining the first end 13 and the second end 14 of the fastening member 12, and passing through the connecting area 12*a* of the fastening member 12, and
- A second plane P2 transverse to the two side planes PL1, PL2 delimiting the insulating body 2, substantially parallel to the first plane P1 and passing through the connecting area 5*a* of the rear face 5,
- At least a third plane P3 transverse to the two side planes PL1, PL2 delimiting the insulating body 2, substantially transverse to the first plane P1 and to the second fastening plane P2, and passing through the furthest elastic branch 11*a* of the fastening means 15 intended to interact with an edge of the support rail, and
- At least a fourth plane P4 transverse to the two side planes PL1, PL2 delimiting the insulating body 2, substantially transverse to the first plane P1 and to the second plane P2 and passing through the retaining member 17 intended to lock a tool.

Therefore, the terminal B6 may be disposed on more depth of the lower face 4 of the terminal block 1 than it would be on a terminal block according to technical art.

Furthermore, the length of the three elastic branches 11*a*, 11*b*, 11*c* defined between the connecting area 5*a* of the rear face 5 of the insulating body 2 and the connecting area 12*a* of the fastening member 12 is greater than the maximum thickness e of the fastening member 12 defined in a plane transverse to the first plane P1.

The arrangement of the terminal B6 as well as the reduction of the thickness of the fastening foot allow to obtain a terminal block with a reduced overall depth P in comparison to a terminal block of the technical art.

In particular, a terminal block 1 according to the invention comprises an overall depth of less than 80 mm, and preferably equal to 78.4 mm.

Although the invention has been described in connection with specific embodiments, it is obvious that it is in no way restricted therein and that it comprises all technical equivalents of the described means as well as their combinations.

The invention claimed is:

1. A terminal block including:

an insulating body delimited by two substantially parallel side planes, a movable fastening foot linked to a connecting area of the rear face of the insulating body and intended to maintain the terminal block on a support rail, wherein the fastening foot comprises at least two elastic branches linking the connecting area of the rear face of the insulating body and a connecting area of a fastening member, the fastening member having an elongated shape extending in a general direction between a first end comprising fastening means intended to interact with an edge of the support rail and a second end comprising a retaining member intended to lock a tool so as to move the fastening foot against the force exerted by the at least two elastic branches, and wherein the terminal block comprises at least one housing for a connection terminal, said housing extending, at least partly within a volume delimited by:

a first plane transverse to the two side planes delimiting the insulating body, substantially parallel to the general direction joining the first end and the second end of the fastening member and passing through the connecting area of the fastening member, and a second plane transverse to the two side planes delimiting the insulating body, substantially parallel to the first plane and passing through the connecting area of the rear face, at least a third plane transverse to the two side planes delimiting the insulating body, substantially transverse to the first plane and to the second plane, and passing through the furthest elastic branch of the fastening means intended to interact with an edge of the support rail, and at least a fourth plane transverse to the two side planes delimiting the insulating body, substantially transverse to the first plane and to second plane, and passing through the retaining member intended to lock a tool.

2. The terminal block according to claim 1, wherein the length of the at least two elastic branches defined between the connecting area of the rear face of the insulating body and the fastening member is greater than the maximum thickness of the fastening member defined in a plane transverse to the first plane.

3. The terminal block according to claim 1, wherein the retaining member comprises the wall of a housing arranged in the fastening member.

4. The terminal block according to claim 3, wherein the housing has a reinforcing rib.

5. A terminal block according claim 1, wherein the insulating body comprises a lug intended to limit the relative motion between an edge of the support rail and the fastening means of the fastening member.

6. The terminal block according to claim 1, wherein the fastening means of the fastening member comprise a lug intended to arrange a bearing for an edge of the support rail.

7. The terminal block according to claim 5, wherein the fastening foot is movable between a first rest position and at least a second position in which the lug of the insulating body is facing the lug of the fastening means of the fastening member.

8. The terminal block according to claim 1, wherein the fastening member has an I-shaped standard profile.

9. The terminal block according to claim 1, wherein the fastening foot comprises three elastic branches.

10. The terminal block according to claim 1, wherein the connection terminal is movable within the housing, two of the housing walls transverse to the two side planes delimiting the insulating body being arranged to guide the motion of the connection terminal.

* * * * *